US008713697B2

(12) United States Patent
Courtney et al.

(10) Patent No.: US 8,713,697 B2
(45) Date of Patent: Apr. 29, 2014

(54) APPARATUS AND METHOD FOR STORING EVENT INFORMATION FOR AN HVAC SYSTEM

(75) Inventors: Michael Courtney, Fort Worth, TX (US); Wojciech Grohman, Little Elm, TX (US); Peter Hrejsa, The Colony, TX (US)

(73) Assignee: Lennox Manufacturing, Inc., Richardson, TX (US)

( * ) Notice: Subject to any disclaimer, the term of this patent is extended or adjusted under 35 U.S.C. 154(b) by 1091 days.

(21) Appl. No.: 12/170,298

(22) Filed: Jul. 9, 2008

(65) Prior Publication Data

US 2010/0011437 A1 Jan. 14, 2010

(51) Int. Cl.
*G06F 21/00* (2013.01)
*G05B 19/408* (2006.01)

(52) U.S. Cl.
USPC ..... 726/27; 340/12.29

(58) Field of Classification Search
USPC ..... 726/1–4, 16, 17, 26–30
See application file for complete search history.

(56) References Cited

U.S. PATENT DOCUMENTS

| | | | |
|---|---|---|---|
| 4,048,491 | A | 9/1977 | Wessman |
| 4,187,543 | A | 2/1980 | Healey et al. |
| 4,231,351 | A | 11/1980 | Bowden et al. |
| 4,262,736 | A | 4/1981 | Gilkeson et al. |
| 4,381,549 | A | 4/1983 | Stamp et al. |
| 4,464,543 | A | 8/1984 | Kline et al. |
| 4,482,785 | A | 11/1984 | Finnegan et al. |
| 4,497,031 | A | 1/1985 | Froehling et al. |
| 4,606,042 | A | 8/1986 | Kahn et al. |
| 4,616,325 | A | 10/1986 | Heckenbach et al. |
| 4,829,447 | A | 5/1989 | Parker et al. |
| 4,843,084 | A | 6/1989 | Parker et al. |
| 4,884,214 | A | 11/1989 | Parker et al. |
| 4,967,567 | A | 11/1990 | Proctor et al. |
| 5,039,980 | A | 8/1991 | Aggers et al. |
| 5,061,916 | A | 10/1991 | French et al. |

(Continued)

FOREIGN PATENT DOCUMENTS

| | | |
|---|---|---|
| EP | 0980165 A2 | 2/2000 |
| EP | 1956311 A2 | 8/2008 |

(Continued)

OTHER PUBLICATIONS

Checket-Hanks, B., "Zoning Controls for Convenience's Sakes, High-End Residential Controls Move Into New Areas," Air Conditioning, Heating & Refrigeration News, ABI /Inform Global, Jun. 28, 2004, 3 pages.

(Continued)

*Primary Examiner* — Gilberto Barron, Jr.
*Assistant Examiner* — David Le

(57) ABSTRACT

An apparatus for storing event information relating to operation of an HVAC system includes: (a) at least one memory controller coupled with the HVAC system for receiving the event information; and (b) at least one memory unit coupled with the at least one memory controller. A first memory unit of the at least one memory unit is configured for receiving first selected information of the event information for accessing by at least one of a first party and a second party. A second memory unit of the at least one memory unit is configured for receiving second selected information of the event information for accessing by the second party.

20 Claims, 10 Drawing Sheets

(56) References Cited

U.S. PATENT DOCUMENTS 5,065,813 A 11/1991 Berkeley et al.
5,086,385 A 2/1992 Launey et al.
5,128,855 A 7/1992 Hilber et al.
5,165,465 A 11/1992 Kenet
5,170,935 A 12/1992 Federspiel et al.
5,259,553 A 11/1993 Shyu
5,274,571 A 12/1993 Hesse et al.
5,278,957 A 1/1994 Chan
5,341,988 A 8/1994 Rein et al.
5,361,982 A 11/1994 Liebi et al.
5,374,200 A 12/1994 Giroux
5,384,697 A 1/1995 Pascucci
5,434,965 A 7/1995 Matheny et al.
5,444,851 A 8/1995 Woest
5,449,112 A 9/1995 Heitman et al.
5,450,570 A 9/1995 Richek et al.
5,463,735 A 10/1995 Pascucci et al.
5,475,364 A 12/1995 Kenet
5,481,481 A 1/1996 Frey et al.
5,511,188 A 4/1996 Pascucci et al.
5,522,044 A 5/1996 Pascucci et al.
5,544,036 A 8/1996 Brown et al.
5,550,980 A 8/1996 Pascucci et al.
5,555,509 A 9/1996 Dolan et al.
5,581,478 A 12/1996 Cruse et al.
5,598,566 A 1/1997 Pascucci et al.
5,613,157 A 3/1997 Davidson et al.
5,621,662 A 4/1997 Humphries et al.
5,631,825 A 5/1997 van Weele et al.
5,675,756 A 10/1997 Benton et al.
5,684,463 A 11/1997 Diercks et al.
5,706,190 A 1/1998 Russ et al.
5,729,442 A 3/1998 Frantz
5,751,948 A 5/1998 Dolan et al.
5,784,647 A 7/1998 Sugimoto
5,793,646 A 8/1998 Hibberd et al.
5,801,942 A 9/1998 Nixon et al.
5,803,357 A 9/1998 Lakin
5,810,245 A 9/1998 Heitman et al.
5,818,347 A 10/1998 Dolan et al.
5,822,512 A 10/1998 Goodrum et al.
5,862,052 A 1/1999 Nixon et al.
5,884,072 A 3/1999 Rasmussen
5,887,651 A 3/1999 Meyer
5,924,486 A 7/1999 Ehlers et al.
5,927,398 A 7/1999 Maciulewicz
5,962,989 A 10/1999 Baker
5,974,554 A 10/1999 Oh
5,976,010 A 11/1999 Reese et al.
5,983,353 A 11/1999 McHann, Jr.
6,052,525 A 4/2000 Carlson et al.
6,061,600 A 5/2000 Ying
6,115,713 A 9/2000 Pascucci et al.
6,141,595 A 10/2000 Gloudeman et al.
6,169,964 B1 1/2001 Alsa et al.
6,170,044 B1 1/2001 McLaughlin et al.
6,240,326 B1 5/2001 Gloudeman et al.
6,241,156 B1 6/2001 Kline et al.
6,271,845 B1 8/2001 Richardson
6,307,331 B1 10/2001 Bonasia et al.
6,349,306 B1 2/2002 Malik et al.
6,359,220 B2 3/2002 Schiedegger et al.
6,363,422 B1 3/2002 Hunter et al.
6,370,037 B1 4/2002 Schoenfish
6,374,373 B1 4/2002 Helm et al.
6,377,283 B1 4/2002 Thomas
6,411,857 B1 6/2002 Flood
6,427,454 B1 8/2002 West
6,430,953 B2 8/2002 Roh
6,437,805 B1 8/2002 Sojoodi et al.
6,441,723 B1 8/2002 Mansfield et al.
6,453,374 B1 9/2002 Kovalan et al.
6,493,661 B1 12/2002 White et al.
6,501,995 B1 12/2002 Kinney et al.
6,505,087 B1 1/2003 Lucas et al.
6,508,407 B1 1/2003 Lefkowitz et al.
6,552,647 B1 4/2003 Thiessen et al.
6,564,348 B1 5/2003 Barenys et al.
6,594,272 B1 7/2003 Ketcham et al.
6,639,939 B1 10/2003 Naden et al.
6,644,557 B1 11/2003 Jacobs
6,717,919 B1 4/2004 Ketcham et al.
6,747,888 B2 6/2004 Klein
6,817,757 B1 11/2004 Wallace
6,833,787 B1 12/2004 Levi
6,868,292 B2 3/2005 Ficco et al.
6,874,691 B1 4/2005 Hildebrand et al.
6,914,893 B2 7/2005 Petite
6,944,785 B2 9/2005 Gadir et al.
6,955,302 B2 10/2005 Erdman, Jr.
6,967,565 B2 11/2005 Lingemann
7,002,462 B2 2/2006 Welch
7,027,808 B2 4/2006 Wesby
7,031,880 B1 4/2006 Seem et al.
7,055,759 B2 6/2006 Wacker et al.
7,085,814 B1 8/2006 Gandhi et al.
7,089,530 B1 8/2006 Dardinski et al.
7,092,768 B1 8/2006 Labuda
7,096,465 B1 8/2006 Dardinski et al.
7,127,327 B1 10/2006 O'Donnell
7,142,948 B2 11/2006 Metz
7,154,866 B2 12/2006 Shurmantine et al.
7,172,160 B2 2/2007 Piel et al.
7,222,111 B1 5/2007 Budke, Jr.
7,225,054 B2 5/2007 Amundson et al.
7,259,666 B1 8/2007 Hermsmeyer et al.
7,281,697 B2 10/2007 Reggiani
7,302,642 B2 11/2007 Smith et al.
7,313,465 B1 12/2007 O'Donnell
7,318,089 B1 1/2008 Stachura et al.
7,337,191 B2 2/2008 Haeberle et al.
7,343,226 B2 3/2008 Ehlers et al.
7,346,433 B2 3/2008 Budike, Jr.
7,349,761 B1 3/2008 Cruse
7,359,335 B2 4/2008 Knop et al.
7,379,791 B2 5/2008 Tamarkin et al.
7,379,997 B2 5/2008 Ehlers et al.
7,418,428 B2 8/2008 Ehlers et al.
7,424,345 B2 9/2008 Norbeck
7,434,744 B2 10/2008 Garozzo et al.
7,439,862 B2 10/2008 Quan
7,446,660 B2 11/2008 Posamentier
7,448,435 B2 11/2008 Garozzo
7,457,853 B1 11/2008 Chari et al.
7,476,988 B2 1/2009 Mulhouse et al.
7,516,106 B2 4/2009 Ehlers et al.
7,526,364 B2 4/2009 Rule et al.
7,567,523 B2 7/2009 Black et al.
7,567,844 B2 7/2009 Thomas et al.
7,571,195 B2 * 8/2009 Billingsley et al. ..... 1/1
7,571,355 B2 8/2009 Shabalin
7,574,871 B2 8/2009 Bloemer et al.
7,584,897 B2 9/2009 Schultz et al.
7,587,459 B2 9/2009 Wewalaarachchi
7,593,124 B1 9/2009 Sheng et al.
7,593,787 B2 9/2009 Feingold et al.
7,604,046 B2 10/2009 Bergman et al.
7,624,931 B2 12/2009 Chapman et al.
7,641,126 B2 1/2010 Schultz et al.
7,650,323 B2 1/2010 Hesse et al.
D610,475 S 2/2010 Beers et al.
7,693,583 B2 4/2010 Wolff et al.
7,693,591 B2 4/2010 Hoglund et al.
7,706,923 B2 4/2010 Amundson et al.
7,730,223 B1 6/2010 Bavor et al.
7,734,572 B2 6/2010 Wiemeyer et al.
7,743,124 B2 6/2010 Holdaway et al.
7,747,757 B2 6/2010 Garglulo et al.
7,752,289 B2 7/2010 Kikkawa et al.
7,761,563 B2 7/2010 Shike et al.
7,774,102 B2 8/2010 Butler et al.
7,797,349 B2 9/2010 Kosaka
7,809,472 B1 10/2010 Silva et al.
7,827,963 B2 11/2010 Li et al.

(56) References Cited

U.S. PATENT DOCUMENTS 7,847,790 B2 12/2010 Bewley et al.
7,861,941 B2 1/2011 Schultz et al.
7,870,080 B2 1/2011 Budike, Jr.
7,886,166 B2 2/2011 Shnekendorf et al.
7,898,147 B2 3/2011 Grabinger et al.
7,904,209 B2 3/2011 Podgorny et al.
7,934,504 B2 5/2011 Lowe et al.
7,949,615 B2 5/2011 Ehlers et al.
7,963,454 B2 6/2011 Sullivan et al.
D642,081 S 7/2011 Kashimoto
7,979,164 B2 7/2011 Garozzo et al.
8,005,576 B2 8/2011 Rodgers
8,024,054 B2 9/2011 Mairs et al.
8,032,254 B2 10/2011 Amundson et al.
8,042,049 B2 10/2011 Killian et al.
D648,641 S 11/2011 Wallaert
D648,642 S 11/2011 Wallaert
8,050,801 B2 11/2011 Richards et al.
8,082,068 B2 12/2011 Rodgers
8,083,154 B2 12/2011 Schultz et al.
8,087,593 B2 1/2012 Leen
8,091,796 B2 1/2012 Amundson et al.
8,099,178 B2 1/2012 Mairs et al.
8,103,390 B2 1/2012 Rodgers
8,112,181 B2 2/2012 Remsburg
8,116,917 B2 2/2012 Rodgers
8,122,110 B1 2/2012 Wilbur et al.
8,127,060 B2 2/2012 Doll et al.
8,167,216 B2 5/2012 Schultz et al.
8,183,995 B2 5/2012 Wang et al.
8,219,249 B2 7/2012 Harrod et al.
8,224,491 B2 7/2012 Koster et al.
8,239,066 B2 8/2012 Jennings et al.
8,239,073 B2 8/2012 Fausak et al.
8,244,383 B2 8/2012 Bergman et al.
8,255,086 B2 8/2012 Grohman
8,255,090 B2 8/2012 Frader-Thompson
8,352,081 B2 1/2013 Grohman
8,437,877 B2 5/2013 Grohman
8,452,906 B2 5/2013 Grohman
8,463,442 B2 6/2013 Curry et al.
8,463,443 B2 6/2013 Grohman et al.
8,548,630 B2 10/2013 Grohman
8,564,400 B2 10/2013 Grohman
2001/0025349 A1 9/2001 Sharood et al.
2001/0055311 A1 12/2001 Trachewsky et al.
2002/0002425 A1 1/2002 Dossey et al.
2002/0013897 A1 1/2002 McTernan et al.
2002/0016639 A1 2/2002 Smith et al.
2002/0033252 A1 3/2002 Sasao et al.
2002/0048194 A1 4/2002 Klein
2002/0053047 A1 5/2002 Gold
2002/0065948 A1* 5/2002 Morris et al. ..... 709/318
2002/0104323 A1 8/2002 Rash et al.
2002/0116550 A1 8/2002 Hansen
2002/0124211 A1 9/2002 Gray et al.
2002/0143523 A1 10/2002 Balaji et al.
2002/0152298 A1 10/2002 Kikta et al.
2002/0157054 A1 10/2002 Shin et al.
2002/0178288 A1 11/2002 McLeod
2002/0191026 A1 12/2002 Rodden et al.
2002/0191603 A1 12/2002 Shin et al.
2002/0198990 A1 12/2002 Bradfield et al.
2003/0061340 A1 3/2003 Sun et al.
2003/0088338 A1 5/2003 Phillips et al.
2003/0097482 A1 5/2003 DeHart et al.
2003/0109963 A1 6/2003 Oppedisano et al.
2003/0116637 A1 6/2003 Ellingham
2003/0154355 A1* 8/2003 Fernandez ..... 711/163
2003/0179721 A1 9/2003 Shurmantine et al.
2003/0191857 A1 10/2003 Terrell et al.
2003/0206100 A1 11/2003 Richman et al.
2004/0001478 A1 1/2004 Wong
2004/0003051 A1 1/2004 Kryzanowski et al.
2004/0003415 A1 1/2004 Ng
2004/0024483 A1 2/2004 Holcombe
2004/0025089 A1 2/2004 Haswarey et al.
2004/0059815 A1 3/2004 Buckingham et al.
2004/0066788 A1 4/2004 Lin et al.
2004/0088069 A1 5/2004 Singh
2004/0111254 A1 6/2004 Gogel et al.
2004/0133314 A1 7/2004 Ehlers et al.
2004/0133704 A1 7/2004 Krzyzanowski
2004/0138981 A1 7/2004 Ehlers et al.
2004/0148482 A1 7/2004 Grundy et al.
2004/0222307 A1 11/2004 DeLuca
2004/0245352 A1 12/2004 Smith et al.
2004/0260427 A1 12/2004 Wimsatt
2004/0260812 A1 12/2004 Rhodes et al.
2004/0260927 A1 12/2004 Grobman
2004/0267385 A1 12/2004 Lingemann
2004/0267395 A1 12/2004 Discenzo et al.
2005/0040247 A1 2/2005 Pouchak
2005/0040250 A1 2/2005 Wruck
2005/0041033 A1 2/2005 Hilts et al.
2005/0046584 A1 3/2005 Breed
2005/0051168 A1 3/2005 DeVries et al.
2005/0073789 A1 4/2005 Tanis
2005/0090915 A1 4/2005 Gelwitz
2005/0097478 A1 5/2005 Killian et al.
2005/0103874 A1 5/2005 Erdman
2005/0119765 A1 6/2005 Bergman
2005/0119771 A1 6/2005 Amundson et al.
2005/0119793 A1 6/2005 Amundson et al.
2005/0119794 A1* 6/2005 Amundson et al. ..... 700/276
2005/0154494 A1 7/2005 Ahmed
2005/0159848 A1 7/2005 Shah et al.
2005/0159924 A1 7/2005 Shah et al.
2005/0182498 A1 8/2005 Landou et al.
2005/0192727 A1 9/2005 Shostak et al.
2005/0198040 A1 9/2005 Cohen et al.
2005/0240312 A1 10/2005 Terry et al.
2005/0252673 A1 11/2005 Kregle et al.
2005/0256591 A1 11/2005 Rule et al.
2005/0256935 A1 11/2005 Overstreet et al.
2005/0258259 A1 11/2005 Stanimirovic
2006/0009861 A1 1/2006 Bonasia
2006/0009863 A1 1/2006 Lingemann
2006/0027671 A1 2/2006 Shah
2006/0036350 A1 2/2006 Bohrer et al.
2006/0036952 A1 2/2006 Yang
2006/0045107 A1 3/2006 Kucenas et al.
2006/0063523 A1 3/2006 McFarland et al.
2006/0105697 A1 5/2006 Aronstam et al.
2006/0159007 A1 7/2006 Frutiger et al.
2006/0185818 A1 8/2006 Garozzo
2006/0192022 A1 8/2006 Barton et al.
2006/0206220 A1 9/2006 Amundson
2006/0212194 A1 9/2006 Breed
2006/0250578 A1 11/2006 Pohl et al.
2006/0250979 A1 11/2006 Gauweller et al.
2006/0267756 A1 11/2006 Kates
2007/0012052 A1 1/2007 Butler et al.
2007/0019683 A1 1/2007 Kryzyanowski
2007/0035255 A1 2/2007 Shuster et al.
2007/0043477 A1 2/2007 Ehlers et al.
2007/0053513 A1 3/2007 Hoffberg
2007/0055757 A1 3/2007 Mairs et al.
2007/0067062 A1 3/2007 Mairs et al.
2007/0097993 A1 5/2007 Bojahra et al.
2007/0109114 A1 5/2007 Farley et al.
2007/0114291 A1 5/2007 Pouchak
2007/0131784 A1 6/2007 Garozzo et al.
2007/0157016 A1 7/2007 Dayan et al.
2007/0194138 A9 8/2007 Shah
2007/0205916 A1 9/2007 Blom et al.
2007/0219645 A1 9/2007 Thomas et al.
2007/0220301 A1 9/2007 Brundridge et al.
2007/0220907 A1 9/2007 Ehlers
2007/0221741 A1 9/2007 Wagner et al.
2007/0233323 A1 10/2007 Wiemeyer et al.
2007/0236156 A1 10/2007 Lys et al.
2007/0241203 A1 10/2007 Wagner et al.
2007/0260782 A1* 11/2007 Shaikli ..... 710/52

(56) References Cited

U.S. PATENT DOCUMENTS

2007/0268667 A1 11/2007 Moorer et al.
2008/0003845 A1 1/2008 Hong et al.
2008/0013259 A1 1/2008 Barton et al.
2008/0029610 A1 2/2008 Nichols
2008/0048046 A1 2/2008 Wagner et al.
2008/0056722 A1 3/2008 Hendrix et al.
2008/0057872 A1 3/2008 McFarland et al.
2008/0057931 A1 3/2008 Nass et al.
2008/0058996 A1 3/2008 Sachdev et al.
2008/0082767 A1 4/2008 Nulkar et al.
2008/0083834 A1 4/2008 Krebs et al.
2008/0120335 A1 5/2008 Dolgoff
2008/0121729 A1 5/2008 Gray
2008/0129475 A1 6/2008 Breed et al.
2008/0144302 A1 6/2008 Rosenblatt
2008/0148098 A1 6/2008 Chen
2008/0161976 A1 7/2008 Stanimirovic
2008/0161978 A1 7/2008 Shah
2008/0167931 A1 7/2008 Gerstemeier et al.
2008/0168255 A1 7/2008 Abou-Emara et al.
2008/0184059 A1 7/2008 Chen
2008/0192649 A1 8/2008 Pyeon et al.
2008/0192745 A1 8/2008 Spears
2008/0195581 A1 8/2008 Ashmore et al.
2008/0198036 A1 8/2008 Songkakul et al.
2008/0216461 A1 9/2008 Nakano et al.
2008/0217419 A1 9/2008 Ehlers et al.
2008/0235611 A1 9/2008 Fraley et al.
2008/0272934 A1 11/2008 Wang et al.
2008/0281472 A1 11/2008 Podgorny et al.
2009/0052105 A1 2/2009 Soleimani et al.
2009/0057424 A1 3/2009 Sullivan et al.
2009/0057425 A1 3/2009 Sullivan et al.
2009/0062964 A1 3/2009 Sullivan et al.
2009/0065597 A1 3/2009 Garozzo et al.
2009/0077423 A1 3/2009 Kim et al.
2009/0094506 A1 4/2009 Lakkis
2009/0105846 A1 4/2009 Hesse et al.
2009/0113037 A1 4/2009 Pouchak
2009/0119092 A1 5/2009 Balasubramanyan
2009/0132091 A1 5/2009 Chambers et al.
2009/0140056 A1 6/2009 Leen
2009/0140057 A1 6/2009 Leen
2009/0140058 A1 6/2009 Koster et al.
2009/0140061 A1 6/2009 Schultz et al.
2009/0140062 A1 6/2009 Amundson et al.
2009/0140063 A1 6/2009 Koster et al.
2009/0140064 A1 6/2009 Schultz et al.
2009/0143879 A1 6/2009 Amundson et al.
2009/0143880 A1 6/2009 Amundson et al.
2009/0143916 A1 6/2009 Boll et al.
2009/0143918 A1 6/2009 Amundson et al.
2009/0157529 A1 6/2009 Ehlers et al.
2009/0195349 A1 8/2009 Frader-Thompson
2009/0198810 A1 8/2009 Bayer et al.
2009/0245278 A1 10/2009 Kee
2009/0257431 A1 10/2009 Ramanathan et al.
2009/0259785 A1 10/2009 Perry et al.
2009/0261767 A1 10/2009 Butler et al.
2009/0266904 A1 10/2009 Cohen
2009/0267540 A1 10/2009 Chemel et al.
2009/0271336 A1 10/2009 Franks
2009/0287736 A1 11/2009 Shike et al.
2010/0011437 A1 1/2010 Courtney
2010/0023865 A1 1/2010 Fulker et al.
2010/0050075 A1 2/2010 Thorson et al.
2010/0050108 A1 2/2010 Mirza
2010/0063644 A1 3/2010 Kansal et al.
2010/0070086 A1 3/2010 Harrod et al.
2010/0070089 A1 3/2010 Harrod et al.
2010/0070093 A1 3/2010 Harrod et al.
2010/0070907 A1 3/2010 Harrod et al.
2010/0073159 A1 3/2010 Schmickley et al.
2010/0076605 A1 3/2010 Harrod et al.
2010/0100253 A1 4/2010 Fausak et al.
2010/0101854 A1 4/2010 Wallaert et al.
2010/0102136 A1 4/2010 Hadzidedic et al.
2010/0102948 A1 4/2010 Grohman et al.
2010/0102973 A1 4/2010 Grohman et al.
2010/0106305 A1 4/2010 Pavlak et al.
2010/0106307 A1 4/2010 Grohman et al.
2010/0106308 A1 4/2010 Filbeck et al.
2010/0106309 A1 4/2010 Grohman et al.
2010/0106310 A1 4/2010 Grohman
2010/0106311 A1 4/2010 Wallaert
2010/0106312 A1 4/2010 Grohman et al.
2010/0106313 A1 4/2010 Grohman et al.
2010/0106314 A1 4/2010 Grohman et al.
2010/0106315 A1 4/2010 Grohman
2010/0106316 A1 4/2010 Curry et al.
2010/0106317 A1 4/2010 Grohman et al.
2010/0106318 A1 4/2010 Grohman et al.
2010/0106319 A1 4/2010 Grohman et al.
2010/0106320 A1 4/2010 Grohman et al.
2010/0106321 A1 4/2010 Hadzidedic
2010/0106322 A1 4/2010 Grohman
2010/0106323 A1 4/2010 Wallaert
2010/0106324 A1 4/2010 Grohman
2010/0106325 A1 4/2010 Grohman
2010/0106326 A1 4/2010 Grohman
2010/0106327 A1 4/2010 Grohman et al.
2010/0106329 A1 4/2010 Grohman
2010/0106330 A1 4/2010 Grohman
2010/0106333 A1 4/2010 Grohman et al.
2010/0106334 A1 4/2010 Grohman et al.
2010/0106787 A1 4/2010 Grohman
2010/0106809 A1 4/2010 Grohman
2010/0106810 A1 4/2010 Grohman
2010/0106814 A1 4/2010 Hadzidedic et al.
2010/0106815 A1 4/2010 Grohman et al.
2010/0106925 A1 4/2010 Grohman et al.
2010/0106957 A1 4/2010 Grohman et al.
2010/0107007 A1 4/2010 Grohman et al.
2010/0107070 A1 4/2010 Devineni et al.
2010/0107071 A1 4/2010 Pavlak et al.
2010/0107072 A1 4/2010 Mirza et al.
2010/0107073 A1 4/2010 Wallaert
2010/0107074 A1 4/2010 Pavlak et al.
2010/0107076 A1 4/2010 Grohman
2010/0107083 A1 4/2010 Grohman
2010/0107103 A1 4/2010 Wallaert
2010/0107109 A1 4/2010 Filbeck et al.
2010/0107110 A1 4/2010 Mirza
2010/0107111 A1 4/2010 Mirza
2010/0107112 A1 4/2010 Jennings et al.
2010/0107232 A1 4/2010 Grohman et al.
2010/0115364 A1 5/2010 Grohman
2010/0131884 A1 5/2010 Shah
2010/0142526 A1 6/2010 Wong
2010/0145528 A1 6/2010 Bergman et al.
2010/0145629 A1 6/2010 Botich et al.
2010/0168924 A1 7/2010 Tessier et al.
2010/0169419 A1 7/2010 DeVilbiss et al.
2010/0179696 A1 7/2010 Grohman et al.
2010/0211546 A1 8/2010 Grohman et al.
2010/0241245 A1 9/2010 Wiemeyer et al.
2010/0259931 A1 10/2010 Chemel et al.
2010/0264846 A1 10/2010 Chemel et al.
2010/0270933 A1 10/2010 Chemel et al.
2010/0272102 A1 10/2010 Kobayashi
2010/0295474 A1 11/2010 Chemel et al.
2010/0295475 A1 11/2010 Chemel et al.
2010/0295482 A1 11/2010 Chemel et al.
2010/0301768 A1 12/2010 Chemel et al.
2010/0301769 A1 12/2010 Chemel et al.
2010/0301770 A1 12/2010 Chemel et al.
2010/0301771 A1 12/2010 Chemel et al.
2010/0301772 A1 12/2010 Chemel et al.
2010/0301773 A1 12/2010 Chemel et al.
2010/0301774 A1 12/2010 Chemel et al.
2010/0305761 A1 12/2010 Remsburg
2010/0314458 A1 12/2010 Votaw et al.
2010/0319362 A1 12/2010 Hisaoka
2011/0001436 A1 1/2011 Chemel et al.

(56) References Cited

U.S. PATENT DOCUMENTS

| | | | |
|---|---|---|---|
| 2011/0001438 | A1 | 1/2011 | Chemel et al. |
| 2011/0004823 | A1 | 1/2011 | Wallaert |
| 2011/0004824 | A1 | 1/2011 | Thorson et al. |
| 2011/0007016 | A1 | 1/2011 | Mirza et al. |
| 2011/0007017 | A1 | 1/2011 | Wallaert |
| 2011/0010620 | A1 | 1/2011 | Mirza et al. |
| 2011/0010621 | A1 | 1/2011 | Wallaert |
| 2011/0010652 | A1 | 1/2011 | Wallaert |
| 2011/0010653 | A1 | 1/2011 | Wallaert |
| 2011/0010660 | A1 | 1/2011 | Thorson et al. |
| 2011/0032932 | A2 | 2/2011 | Pyeon et al. |
| 2011/0040785 | A1 | 2/2011 | Steenberg et al. |
| 2011/0061014 | A1 | 3/2011 | Frader-Thompson et al. |
| 2011/0063126 | A1 | 3/2011 | Kennedy et al. |
| 2011/0066297 | A1 | 3/2011 | Saberi et al. |
| 2011/0160915 | A1 | 6/2011 | Bergman et al. |
| 2011/0251726 | A1 | 10/2011 | McNulty et al. |
| 2012/0012662 | A1 | 1/2012 | Leen et al. |
| 2012/0046792 | A1 | 2/2012 | Secor |
| 2012/0065805 | A1 | 3/2012 | Montalvo |
| 2012/0116593 | A1 | 5/2012 | Amundson et al. |
| 2012/0181010 | A1 | 7/2012 | Schultz et al. |

FOREIGN PATENT DOCUMENTS

| | | | |
|---|---|---|---|
| EP | 2241836 | A1 | 10/2010 |
| EP | 2241837 | A1 | 10/2010 |
| GB | 2117573 | A | 10/1983 |
| WO | 02056540 | A2 | 7/2002 |
| WO | 2008100641 | A1 | 8/2008 |

OTHER PUBLICATIONS

Leeb, G., "A User Interface for Home-Net," IEEE Transactions on Consumer Electronics, vol. 40, Issue 4, Nov. 1994, pp. 897-902.

"IPMI—Intelligent Platform Management Interface Specification v1.5," Document Revision 1.1, Intel Hewlett-Packard NEC Dell, Feb. 20, 2002, 460 pages.

Nash, H., "Fire Alarm Systems for Health Care Facilities," IEEE Transactions on Industry Applications, vol. 1A-19, No. 5, Sep./ Oct. 1983, pp. 848-852.

Bruggeman, E., et al., "A Multifunction Home Control System," IEEE Transactions on Consumer Electronics, CE-29, Issue 1, 10 pages.

Fischer, H., et al., "Remote Building Management and DDc-Technology to Operate Distributed HVAC-Installations," The first International Telecommunications Energy Special Conference, Telescon '94, Apr. 11-15, 1994, pp. 127-132.

Gallas, B., et al., " Embedded Pentium® Processor System Design for Windows CE," Wescon 1998, pp. 114-123.

"iView-100 Series (iView/iView-100-40) Handheld Controller User's Manual," ICP DAS, Mar. 2006, Version 2.0.

"Spectra™ Commercial Zoning System, Engineering Data," Lennox, Bulletin No. 210366E, Oct. 2002, 33 pages.

Sharma, A., "Design of Wireless Sensors Network for Building Management Systems," University of California-Berkley, 57 pages.

"Linux Programmer's Manual, UNIX Man Pages: Login (1), "http://unixhelp.ed.ac.uk/CGI/man-cgi?login, Util-linux 1.6, Nov. 4, 1996, 4 pages.

"Field Display for Tridium Jace Controllers Product Data," HVAC Concepts, Inc. 2005, 22 pages.

"HVAC Concepts," Jace Network-Installation, 2004, 2 pages.

Bruggeman, E., et al., "A Multifunction Home Control System," IEEE Transactions on Consumer Electronics, CE-29, Issue 1, Feb. 1983, 10 pages.

Sharma, A., "Design of Wireless Sensors Network for Building Management Systems," University of California-Berkley, 2003, 57 pages.

"Definition of encase by The Free Dictionary," http://www.thefreedictionary.com/encase, 2013, 2 pages.

"Define Track at Dictionary.com ," http://dictionary.reference.com/browse/track, Mar. 12, 2013, 3 pages.

"Definition of Track by Macmillan Dictionary," http://www.macmillandictionary.com/dictionary/british/track, Mar. 12, 2013, 4 pages.

"Definition of track by the Free Online Dictionary, Thesaurus, and Encyclopedia," http://www.thefreedictionary.com/track, Mar. 12, 2013, 6 pages.

* cited by examiner

10

60

110

APPARATUS AND METHOD FOR STORING EVENT INFORMATION FOR AN HVAC SYSTEM

BACKGROUND OF THE INVENTION

The present invention is directed to heating ventilating air conditioning (HVAC) systems, and especially to collection of event or operation data or information in HVAC systems.

Users of HVAC systems such as, by way of example and not by way of limitation, homeowners may prefer that only minimal information be displayed or otherwise presented to them to inform them of details regarding operation of the HVAC system. Too much information may be confusing or frustrating to a homeowner. Further, there is little need for a homeowner to remember when certain events may have occurred.

In contrast, greater detail of information regarding operation or events regarding the HVAC system, including when events may have occurred, may be quite valuable to a serviceman seeking to diagnose or debug a problem. Generally speaking, the more information that may be made available regarding operation of an HVAC system, the easier it is to service the system, and the easier it is to develop improvements to the system.

The information is from a common system and may be collected at the same time, but it would be advantageous to present different presentations of the information—a less detailed version to a user, and a more detailed version to a serviceman or other professional.

There is a need for an apparatus and method for storing event information for an HVAC system that can present differing levels of information detail to different users.

SUMMARY OF THE INVENTION

An apparatus for storing event information relating to operation of an HVAC system includes: (a) at least one memory controller coupled with the HVAC system for receiving the event information; and (b) at least one memory unit coupled with the at least one memory controller. A first memory unit of the at least one memory unit is configured for receiving first selected information of the event information for accessing by at least one of a first party and a second party. A second memory unit of the at least one memory unit is configured for receiving second selected information of the event information for accessing by the second party.

A method for storing event information relating to operation of an HVAC system includes: (a) providing at least one memory controller coupled with the HVAC system for receiving the event information; (b) providing at least one memory unit coupled with the at least one memory controller; (c) in no particular order: (1) configuring a first memory unit of the at least one memory unit for storing first selected information of the event; and (2) configuring a second memory unit of the at least one memory unit for storing second selected information of the event information; and (d) in no particular order: (1) operating the first memory unit for permitting access to the first selected information by at least one of a first party and a second party; and (2) operating the second memory unit for permitting access to the second selected information by the second party.

It is, therefore, a feature of the present invention to present an apparatus and method for storing event information for an HVAC system that can present differing levels of information detail to different users.

Further features of the present invention will be apparent from the following specification and claims when considered in connection with the accompanying drawings, in which like elements are labeled using like reference numerals in the various figures, illustrating the preferred embodiments of the invention.

DETAILED DESCRIPTION

Figure 1:
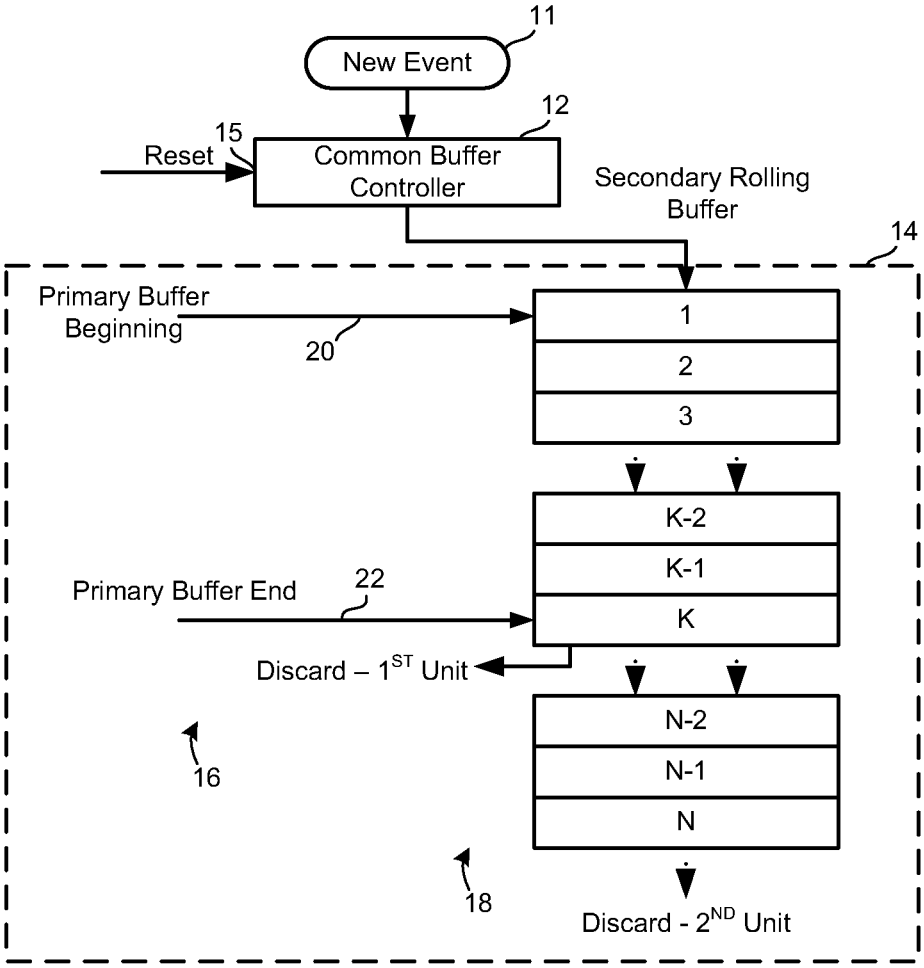
FIG. 1 is a schematic diagram of a first embodiment of the apparatus of the invention.

A new apparatus and method for storing and displaying operational event information such as, by way of example and not by way of limitation, error codes in an HVAC system involves having two memory buffers storing the event information. The HVAC system may be a communicating HVAC system included in a communicating HVAC network involving a plurality of HVAC systems. The present invention may be employed in some or all of the HVAC systems in an HVAC network.

Generally, a first buffer stores all operational information, such as by way of example and not by way of limitation, events, error codes or alarms present in the system. Each event may be identified with time stamping or storage may be effected in a chronological order. A further option may be to record consecutive, substantially identical events as one entry with an event counter associated with the entry to count the number of times the same event is consecutively presented.

A second buffer is preferably independent of the first buffer. The second buffer may store the same information that is stored in the first buffer. Time stamps or chronological storing may be employed in the second buffer. The second buffer substantially duplicates the information stored in the first buffer. However, information in the second buffer is preferably not reset when the primary buffer is reset. It may be advantageous to provide that the second buffer store any resetting of the primary buffer as an event. It is preferred that access to the second buffer be controlled to limit disclosure of information stored in the second buffer to authorized persons.

Access to information stored in the second buffer may require use of a non-published, secret access code or another access control arrangement.

Either of the first and second buffers can store information in RAM (Random Access Memory) or in a non-volatile memory independently of each other. The first and second buffers may reside on the same HVAC system or may reside on different HVAC systems.

Preferably, both of the first and second buffers may be reset and cleared independently of each other by the person or an apparatus servicing the HVAC system or clearing of an individual device in an HVAC system in which the buffers may reside.

Buffer content for either of the first and second buffers preferably may be displayed in a human-readable form on any appropriate device in an HVAC system including, by way of example and not by way of limitation, a thermostat, zoning panel, furnace controller or any other control with a human-machine interface able to display information.

Buffer content may also be displayed on a remote device with human-machine interface such as a thermostat, home security panel, home automation panel, a personal digital assistant, a cellular phone, a wireless phone, a personal computer, a television set any other device connected to the HVAC system over a proprietary or common communicating interface such as wired or wireless Ethernet connection, Universal Serial Bus connection, RS-232 connection or other interface.

FIG. 1 is a schematic diagram of a first embodiment of the apparatus of the invention. In FIG. 1, an information storing system 10 for an HVAC (Heating Ventilating Air Conditioning) system includes a memory controller 12 and a memory section 14. Memory section 14 includes a first memory unit 16 and a second memory unit 18. Second memory unit 18 includes a plurality of memory sites 1, 2, 3, . . . K−2, K−1, K, . . . N−2, N−1, N. First memory unit 16 is a virtual memory unit having pointers 20, 22. Pointer 20 is a beginning pointer that remains pointed at memory site 1 to mark the beginning of first memory unit 16, so long as there is data stored in first memory unit 16. Pointer 22 is an ending pointer that points to the memory site containing the earliest-stored event within memory sites 1 through K.

Event data is provided to memory controller 12 from a host HVAC system (not shown in FIG. 1) via an event data input locus 11. Memory controller 12 also has a RESET locus 15 via which memory controller 12 may receive RESET signals. A RESET signal may cause memory controller 12 to move pointers 20, 22 to positions not indicating any data in second memory unit 18 is intended for consideration as being stored in first memory unit 16. Alternatively, memory controller 12 may respond to a RESET signal by eliminating one or both of pointers 20, 22 until needed to indicate that data in second memory unit 18 is intended for consideration as being stored in first memory unit 16.

First memory unit 16 operates as a rolling buffer memory unit, "bumping" event data or information to a next memory cell when new event data is received and stored. Thus, event data is stored on a first-in-first-out basis in first memory unit 16. First memory unit 16 discards event information after the event information is "bumped" from memory site K.

Second memory unit 18 also operates as a rolling buffer memory unit, "bumping" event data to a next memory cell when new event data is received and stored. Thus, event data is stored on a first-in-first-out basis in second memory unit 18. Second memory unit 18 keeps event data stored for a longer period than first memory unit 16. Second memory unit 18 keeps event data stored longer than it takes to fill memory site K. Second memory unit 18 discards event information after the event information is "bumped" from memory site N. N is greater than K.

In a preferred embodiment of HVAC system information store 10, pointers 20, 22 simply identify which memory sites 1 through K are included in first memory unit 16. However, not all information stored in memory sites 1 through K is to be regarded as stored in first memory unit 16. One may recall that the intent of first memory unit 16 is to provide less complex, less confusing information for a user, such as a homeowner. Thus, it is preferred that selected information stored in memory sites 1 through K, but not necessarily all information stored in memory sites 1 through K, may be regarded as stored in first memory unit 16 and may be displayed to a user without limiting access.

Events stored in information store 10 may include alarm events. Alarm events may be continuous alarms, occasion-based alarms or alarm clears. Continuous alarms may relate to a continuously monitored event such as an event indicated by a sensor. By way of example and not by way of limitation, a continuous alarm may relate to whether a particular window to a conditioned space is open. An occasion-based alarm may relate to an occurrence of a particular event such as, by way of example and not by way of limitation, failure by a control unit to achieve a requisite thermal condition to permit lighting a furnace. Thus, an event alarm may be entered or stored in information store 10 on each occasion of failure by a control unit to achieve a requisite thermal condition to permit lighting a furnace.

Information store 10 may also store circumstances generally occurring with an alarm, including by way of example and not by way of limitation, specified parameters extant when an alarm occurs, specified parameters extant shortly before an alarm occurs, specified parameters extant shortly after an alarm occurs or specified parameters during a time interval spanning a time at which an alarm occurs.

An alarm clear preferably identifies at least one earlier occurring alarm to which the alarm clear pertains. By way of example and not by way of limitation, an alarm clear may effect clearing of an earlier-occurring continuous alarm (e.g., indicating that a offending window has been closed). An alarm clear may effect clearing of all active or pending event alarms relating to a particular occasion or event that are identified by the alarm clear. By way of further example and not by way of limitation, upon successful lighting of a furnace an alarm clear may be or stored in information store 10 to effect clearing of all active or pending alarms relating to each occasion of failure by a control unit to achieve a requisite thermal condition to permit lighting a furnace.

It is preferred that first memory unit 16 and second memory unit 18 be embodied in a non-volatile type memory device or unit. A volatile memory unit such as, by way of example and not by way of limitation, a Random Access Memory (RAM) memory unit may be employed when it is desired that information stored in a memory device be erased or otherwise removed or lost whenever the volatile memory device or unit is reset.

By way of example and not by way of limitation, events entered into first memory unit 16 may be provided upon the occasion of resetting a short-term RAM device for storing events (not shown in FIG. 1; understood by those skilled in the art of memory system design). Using such an arrangement, events may be first entered into a RAM memory unit substantially upon their respective occurrences, and whenever the RAM memory unit is reset or otherwise cleared, entries in the RAM memory unit are first transferred to first memory unit 16 before being removed from the RAM memory unit. By way of example and not by way of limitation, a RAM memory unit may be cleared in response to a clearing action by a user, a clearing action by a repair person or in response to another event.

Figure 2:
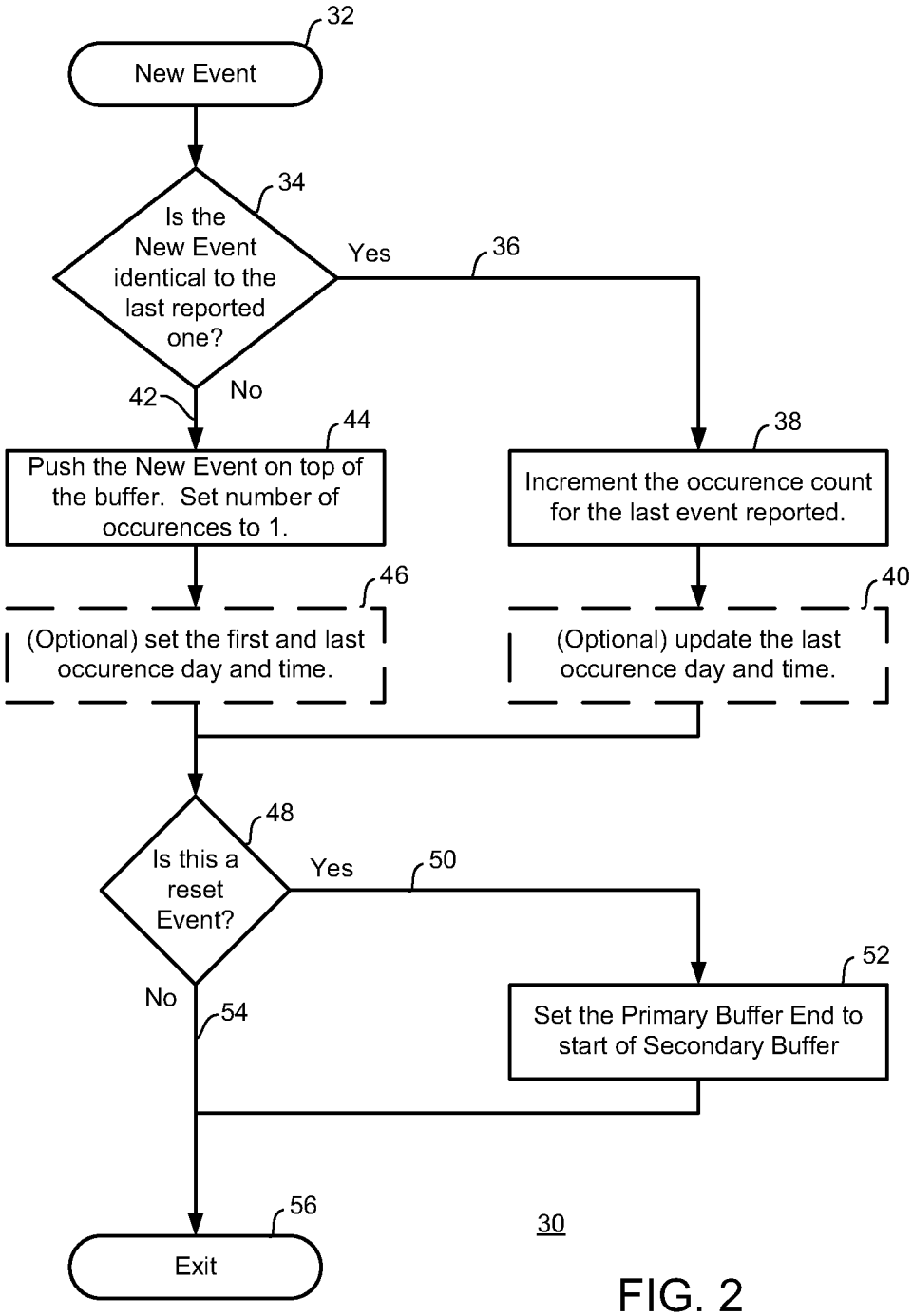
FIG. 2 is a flow chart illustrating treatment of event information in the embodiment of the apparatus illustrated in FIG. 1.

FIG. 2 is a flow chart illustrating treatment of event information in the embodiment of the apparatus illustrated in FIG. 1. In FIG. 2, a treatment protocol 30 begins with the occurrence of a new event, as indicated by a beginning locus 32.

Treatment protocol 30 continues by posing a query whether the new event being treated is substantially identical to the last reported event, as indicated by a query block 34. If the new event is substantially identical to the last reported event, treatment protocol 30 continues from query block 34 via a YES response line 36 and an occurrence count for the last event reported is incremented, as indicated by a block 38. Maintaining an incremented count for tracking substantially identical occurrences is a treatment step that permits counting occurrences while conserving memory. Alternatively, each separate occurrence may be accounted for using a separate memory entry and no occurrence count may be required.

Treatment protocol 30 continues by updating the recorded day and time of occurrence of the latest-to-occur similar event, as indicated by a block 40. Updating the recorded day and time of occurrence of the latest-to-occur similar event may be an optional treatment step, as indicated by the broken line format of block 40. If an alternate design is employed in which a separate occurrence is accounted for using a separate memory entry, a date and time entry may accompany the event notation in storage and no updating of the day and time of occurrence of the latest-to-occur similar event may be required.

If the new event is not substantially identical to the last reported event, treatment protocol 30 continues from query block 34 via a NO response line 42 and a record of the occurrence of the new event is pushed to the top of a memory buffer, as indicated by a block 44. When the record of the occurrence of the new event is pushed to the top of a memory buffer, a count indicating occurrence of the new event may be set to 1, as also indicated by block 44. Treatment protocol 30 may continue by setting the first and last occurrence day and time entries for the new event, as indicated by a block 46. Setting the first and last occurrence day and time entries for the new event may be an optional treatment step, as indicated by the broken line format of block 46.

Treatment protocol 30 may continue from block 40 or from block 46 by posing a query whether the new event being treated is a reset event, as indicated by a query block 48. If the new event is a reset event, treatment protocol 30 continues from query block 48 via a YES response line 50 and the primary buffer end (see element 22; FIG. 1) is set to the primary buffer beginning (see element 20; FIG. 1) at the beginning of the secondary buffer (see second memory unit 18; FIG. 1), as indicated by a block 52. Treatment protocol 30 proceeds from block 52 to an exit locus 56. If the new event is not a reset event, treatment protocol 30 continues from query block 48 via a NO response line 54 to exit locus 56.

Figure 3:
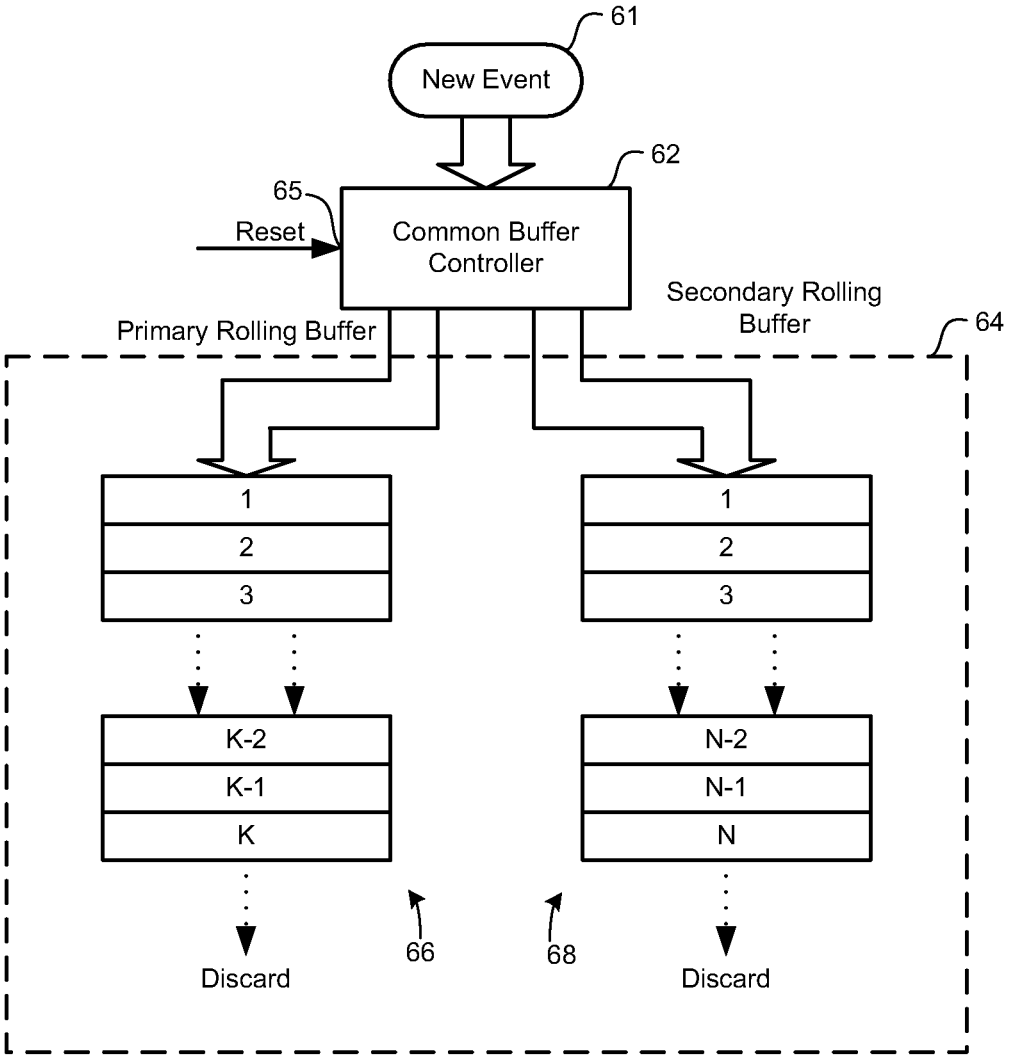
FIG. 3 is a schematic diagram of a second embodiment of the apparatus of the invention.

FIG. 3 is a schematic diagram of a second embodiment of the apparatus of the invention. In FIG. 3, an information storing system or information store 60 for an HVAC (Heating Ventilating Air Conditioning) system includes a common memory controller 62 and a memory section 64. Memory section 64 includes a first memory unit 66 and a second memory unit 68. First memory unit 66 includes a plurality of memory sites 1, 2, 3, . . . K−2, K−1, K. Second memory unit 68 includes a plurality of memory sites 1, 2, 3, . . . N−2, N−1, N.

Event data is provided to memory controller 62 from a host HVAC system (not shown in FIG. 3) via an event data input locus 61. Memory controller 62 also has a RESET locus 65 via which memory controller 62 may receive RESET signals. A RESET signal may cause memory controller 62 to reset or erase entries in first memory unit 66 or to otherwise empty first memory unit 66. Response by information storing system 60 to a RESET signal is described in greater detail in connection with FIG. 5.

First memory unit 66 operates as a rolling buffer memory unit, "bumping" event data or information to a next memory cell when new event data is received and stored. Thus, event data is stored on a first-in-first-out basis in first memory unit 66. First memory unit 66 discards event information after the event information is "bumped" from memory site K.

Second memory unit 68 also operates as a rolling buffer memory unit, "bumping" event data to a next memory cell when new event data is received and stored. Thus, event data is stored on a first-in-first-out basis in second memory unit 68. Second memory unit 68 keeps event data stored for a longer period than first memory unit 66. Second memory unit 68 discards event information after the event information is "bumped" from memory site N. N is greater than K.

In a preferred embodiment of HVAC system information store 60, not all information stored in first memory unit 66 in memory sites 1 through K is the same information stored in second memory unit 68 in memory sites 1 through K, or in memory sites K+1 through N. One may recall that the intent of first memory unit 66 is to provide less complex, less confusing information for a user, such as a homeowner. Thus, it is preferred that selected information stored in first memory unit 66 in memory sites 1 through K may contain fewer data entries than information stored in second memory unit 68 in memory sites 1 through K, and in memory sites K+1 through N.

Events stored in information store 60 may include alarm events. Alarm events may be continuous alarms, occasion-based alarms or alarm clears. Continuous alarms may relate to a continuously monitored event such as an event indicated by a sensor. By way of example and not by way of limitation, a continuous alarm may relate to whether a particular window to a conditioned space is open. An occasion-based alarm may relate to an occurrence of a particular event such as, by way of example and not by way of limitation, failure by a control unit to achieve a requisite thermal condition to permit lighting a furnace. Thus, an event alarm may be entered or stored in information store 60 on each occasion of failure by a control unit to achieve a requisite thermal condition to permit lighting a furnace.

Information store 60 may also store circumstances generally occurring with an alarm, including by way of example and not by way of limitation, specified parameters extant when an alarm occurs, specified parameters extant shortly before an alarm occurs, specified parameters extant shortly after an alarm occurs or specified parameters during a time interval spanning a time at which an alarm occurs.

An alarm clear preferably identifies at least one earlier occurring alarm to which the alarm clear pertains. By way of example and not by way of limitation, an alarm clear may effect clearing of an earlier-occurring continuous alarm (e.g., indicating that a offending window has been closed). An alarm clear may effect clearing of all active or pending event alarms relating to a particular occasion or event that are identified by the alarm clear. By way of further example and not by way of limitation, upon successful lighting of a furnace an alarm clear may be or stored in information store 60 to effect clearing of all active or pending alarms relating to each occasion of failure by a control unit to achieve a requisite thermal condition to permit lighting a furnace.

It is preferred that first memory unit 66 and second memory unit 68 be embodied in a non-volatile type memory device or unit. A volatile memory unit such as, by way of example and not by way of limitation, a Random Access Memory (RAM) memory unit may be employed when it is desired that information stored in a memory device be erased or otherwise removed or lost whenever the volatile memory device or unit is reset.

By way of example and not by way of limitation, events entered into first memory unit 66 may be provided upon the occasion of resetting a short-term RAM device for storing events (not shown in FIG. 3; understood by those skilled in the art of memory system design). Using such an arrangement, events may be first entered into a RAM memory unit substantially upon their respective occurrences, and whenever the RAM memory unit is reset or otherwise cleared, entries in the RAM memory unit are first transferred to first memory unit 66 before being removed from the RAM memory unit. By way of example and not by way of limitation, a RAM memory unit may be cleared in response to a clearing action by a user, a clearing action by a repair person or in response to another event.

Figure 4:
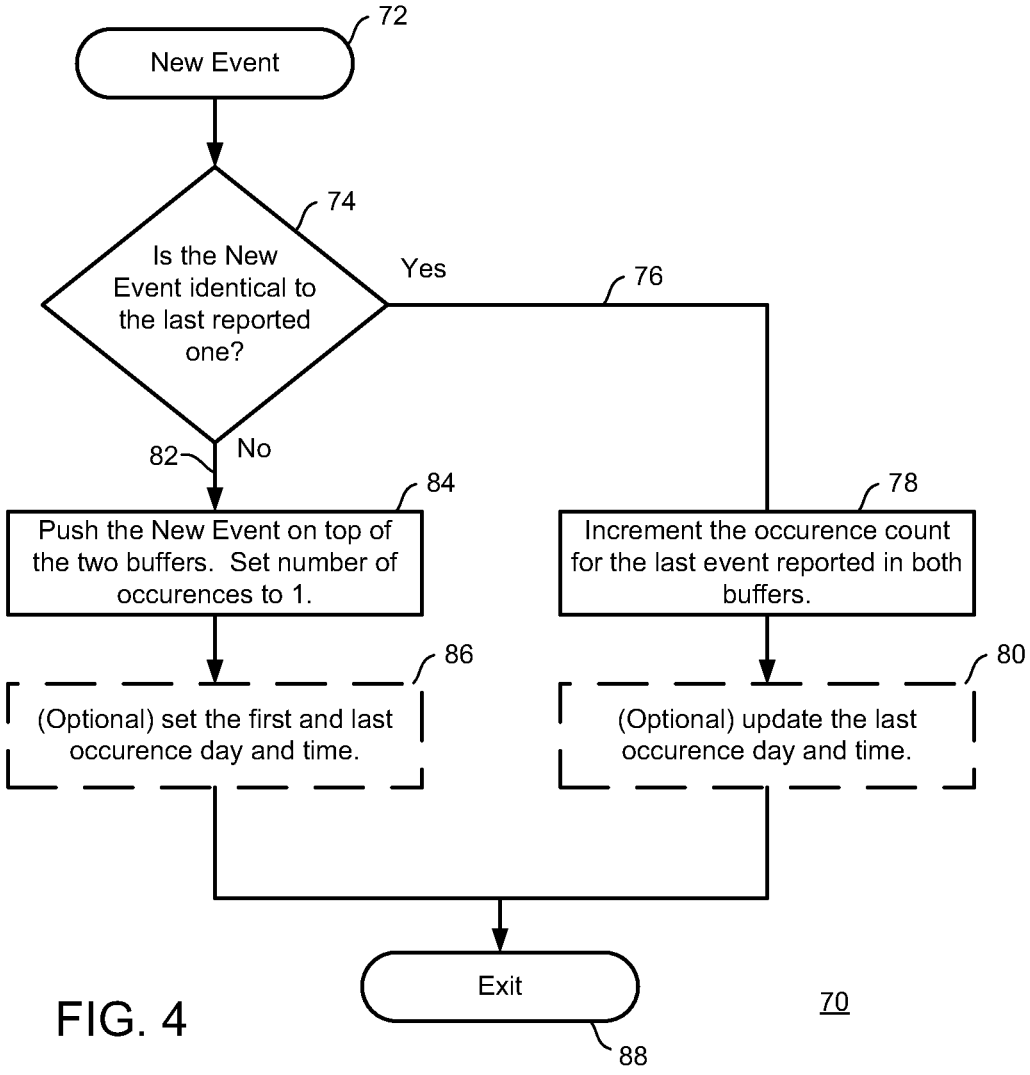
FIG. 4 is a flow chart illustrating treatment of event information in the embodiment of the apparatus illustrated in FIG. 3.

FIG. 4 is a flow chart illustrating treatment of event information in the embodiment of the apparatus illustrated in FIG. 3. In FIG. 4, a treatment protocol 70 begins with the occurrence of a new event, as indicated by a beginning locus 72.

Treatment protocol 70 continues by posing a query whether the new event being treated is substantially identical to the last reported event, as indicated by a query block 74. If the new event is substantially identical to the last reported event, treatment protocol 70 continues from query block 74 via a YES response line 76 and an occurrence count for the last event reported is incremented in both memory units 66, 68 (FIG. 3), as indicated by a block 78. Maintaining an incremented count for tracking substantially identical occurrences is a treatment step that permits counting occurrences while conserving memory. Alternatively, each separate occurrence may be accounted for using a separate memory entry and no occurrence count may be required.

Treatment protocol 70 continues by updating the recorded day and time of occurrence of the latest-to-occur similar event, as indicated by a block 80. Updating the recorded day and time of occurrence of the latest-to-occur similar event may be an optional treatment step, as indicated by the broken line format of block 80. If an alternate design is employed in which a separate occurrence is accounted for using a separate memory entry, a date and time entry may accompany the event notation in storage and no updating of the day and time of occurrence of the latest-to-occur similar event may be required.

If the new event is not substantially identical to the last reported event, treatment protocol 70 continues from query block 74 via a NO response line 82 and a record of the occurrence of the new event is pushed to the top of both memory units 66, 68, as indicated by a block 84. When the record of the occurrence of the new event is pushed to the top of both memory units 66, 68, a count indicating occurrence of the new event may be set to 1, as also indicated by block 84. Treatment protocol 70 may continue by setting the first and last occurrence day and time entries for the new event, as indicated by a block 86. Setting the first and last occurrence day and time entries for the new event may be an optional treatment step, as indicated by the broken line format of block 86.

Treatment protocol 30 may continue from block 80 or from block 86 to an exit locus 88.

Figure 5:
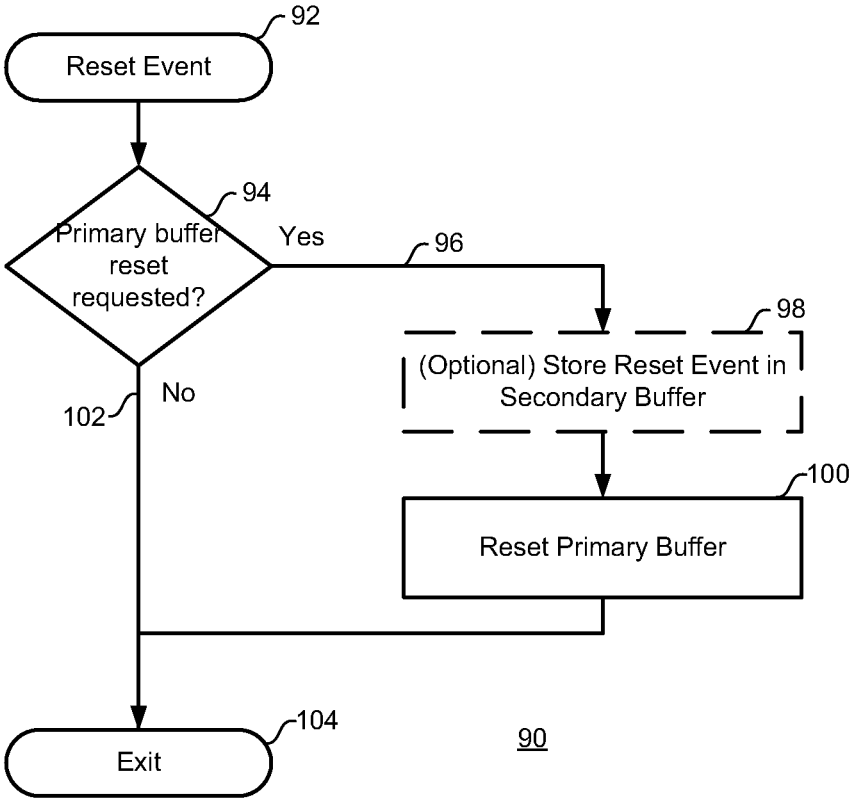
FIG. 5 is a flow diagram illustrating treatment of a reset event in the embodiment of the apparatus illustrated in FIG. 3.

FIG. 5 is a flow diagram illustrating treatment of a reset event in the embodiment of the apparatus illustrated in FIG. 3. In FIG. 5, a treatment protocol 90 begins with the occurrence of a reset event, as indicated by a beginning locus 92. A reset event may occur, by way of example and not by way of limitation, when a RESET signal or other RESET indication is received at a RESET locus (e.g., RESET locus 65; FIG. 3). A reset event may cause a resetting or erasing of entries in a memory unit or may otherwise empty a memory unit.

Treatment protocol 90 continues by posing a query whether a resetting of a primary buffer (e.g., first memory unit 66; FIG. 3) is being requested, as indicated by a query block 94. If a resetting of a primary buffer is being requested, treatment protocol 90 continues from query block 94 via a YES response line 96 information relating to the reset event is stored in the secondary buffer (e.g., second memory unit 68; FIG. 3), as indicated by a block 98. Such related information to be stored may include, by way of example and not by way of limitation, the occurrence of a reset event, and the date and time of the occurrence. Storing information relating to the reset event may be an optional treatment step, as indicated by the broken line format of block 98.

Treatment protocol 90 may continue by resetting the primary buffer (e.g., first memory unit 66; FIG. 3), as indicated by a block 100. Treatment protocol 90 may continue from block 100 to an exit locus 104.

If a resetting of a primary buffer is not being requested, treatment protocol 90 continues from query block 94 via a NO response line 102 to exit locus 104.

Figure 6:
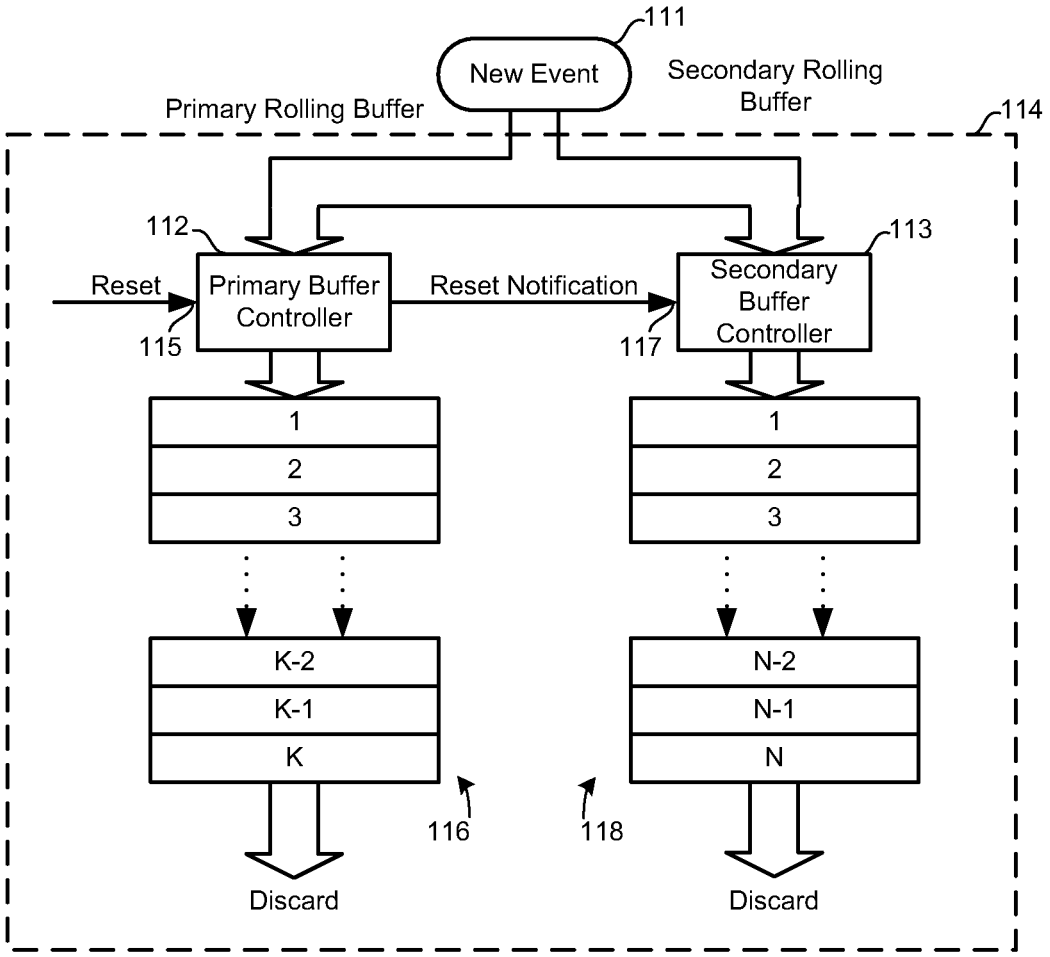
FIG. 6 is a schematic diagram of a third embodiment of the apparatus of the invention.

FIG. 6 is a schematic diagram of a third embodiment of the apparatus of the invention. In FIG. 6, an information storing system 110 for an HVAC (Heating Ventilating Air Conditioning) system includes a first memory controller 112, a second memory controller 113 and a memory section 114. Memory section 114 includes a first memory unit 116 and a second memory unit 118. First memory unit 116 includes a plurality of memory sites 1, 2, 3, . . . K−2, K−1, K. Second memory unit 118 includes a plurality of memory sites 1, 2, 3, . . . N−2, N−1, N.

Event data is provided to memory controllers 112, 113 from a host HVAC system (not shown in FIG. 6) via an event data input locus 111. Memory controller 112 has a RESET locus 115 via which memory controller 112 may receive RESET signals. A RESET signal may cause memory controller 112 to reset or erase entries in first memory unit 116 or to otherwise empty first memory unit 116. Memory controller 113 has a RESET locus 117 via which memory controller 113 may receive indications of RESET signals received by memory controller 112. In an alternate arrangement, RESET locus 117 may be coupled with RESET locus 115. A RESET signal may cause memory controller 112 to reset or erase entries in first memory unit 116 or to otherwise empty first memory unit 116. Response by information storing system 110 to a RESET signal is described in greater detail in connection with FIGS. 8 and 10.

First memory unit 116 operates as a rolling buffer memory unit, "bumping" event data or information to a next memory cell when new event data is received and stored. Thus, event data is stored on a first-in-first-out basis in first memory unit 116. First memory unit 116 discards event information after the event information is "bumped" from memory site K.

Second memory unit 118 also operates as a rolling buffer memory unit, "bumping" event data to a next memory cell when new event data is received and stored. Thus, event data is stored on a first-in-first-out basis in second memory unit 118. Second memory unit 118 keeps event data stored for a longer period than first memory unit 116. Second memory unit 118 discards event information after the event information is "bumped" from memory site N. N is greater than K.

In a preferred embodiment of HVAC system information store 110, not all information stored in first memory unit 116 in memory sites 1 through K is the same information stored in second memory unit 118 in memory sites 1 through K, or in memory sites K+1 through N. One may recall that the intent of first memory unit 116 is to provide less complex, less confusing information for a user, such as a homeowner. Thus, it is preferred that selected information stored in first memory unit 116 in memory sites 1 through K may contain fewer data entries than information stored in second memory unit 118 in memory sites 1 through K, and in memory sites K+1 through N.

Events stored in information store 10 may include alarm events. Alarm events may be continuous alarms, occasion-based alarms or alarm clears. Continuous alarms may relate to a continuously monitored event such as an event indicated by a sensor. By way of example and not by way of limitation, a continuous alarm may relate to whether a particular window to a conditioned space is open. An occasion-based alarm may relate to an occurrence of a particular event such as, by way of example and not by way of limitation, failure by a control unit to achieve a requisite thermal condition to permit lighting a furnace. Thus, an event alarm may be entered or stored in information store 110 on each occasion of failure by a control unit to achieve a requisite thermal condition to permit lighting a furnace.

Information store 110 may also store circumstances generally occurring with an alarm, including by way of example and not by way of limitation, specified parameters extant when an alarm occurs, specified parameters extant shortly before an alarm occurs, specified parameters extant shortly after an alarm occurs or specified parameters during a time interval spanning a time at which an alarm occurs.

An alarm clear preferably identifies at least one earlier occurring alarm to which the alarm clear pertains. By way of example and not by way of limitation, an alarm clear may effect clearing of an earlier-occurring continuous alarm (e.g., indicating that a offending window has been closed). An alarm clear may effect clearing of all active or pending event alarms relating to a particular occasion or event that are identified by the alarm clear. By way of further example and not by way of limitation, upon successful lighting of a furnace an alarm clear may be or stored in information store 10 to effect clearing of all active or pending alarms relating to each occasion of failure by a control unit to achieve a requisite thermal condition to permit lighting a furnace.

It is preferred that first memory unit 116 and second memory unit 118 be embodied in a non-volatile type memory device or unit. A volatile memory unit such as, by way of example and not by way of limitation, a Random Access Memory (RAM) memory unit may be employed when it is desired that information stored in a memory device be erased or otherwise removed or lost whenever the volatile memory device or unit is reset.

By way of example and not by way of limitation, events entered into first memory unit 116 may be provided upon the occasion of resetting a short-term RAM device for storing events (not shown in FIG. 6; understood by those skilled in the art of memory system design). Using such an arrangement, events may be first entered into a RAM memory unit substantially upon their respective occurrences, and whenever the RAM memory unit is reset or otherwise cleared, entries in the RAM memory unit are first transferred to first memory unit 116 before being removed from the RAM memory unit. By way of example and not by way of limitation, a RAM memory unit may be cleared in response to a clearing action by a user, a clearing action by a repair person or in response to another event.

Figure 7:
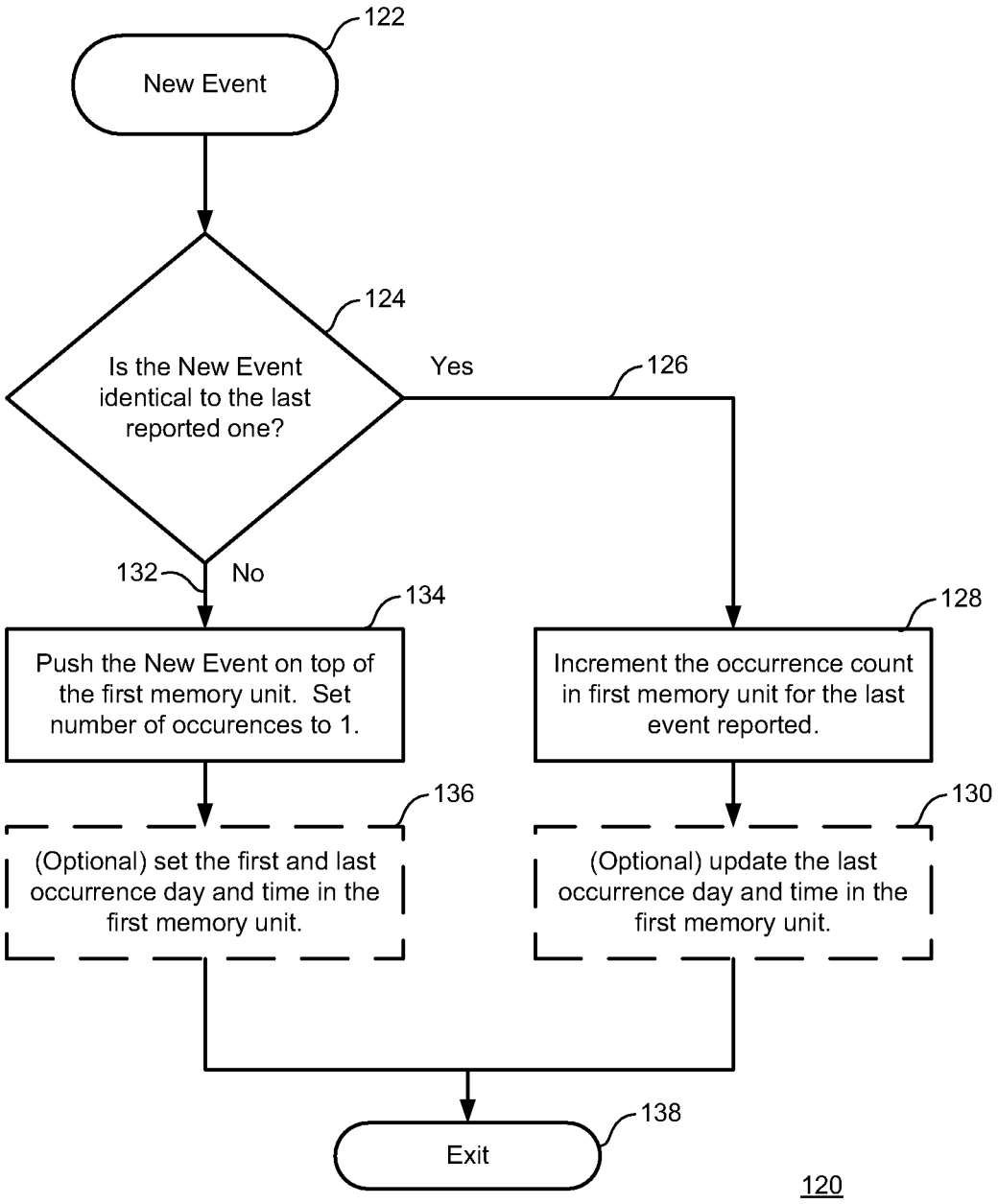
FIG. 7 is a flow chart illustrating treatment of event information in a first buffer unit of the embodiment of the apparatus illustrated in FIG. 6.

FIG. 7 is a flow chart illustrating treatment of event information in a first buffer unit of the embodiment of the apparatus illustrated in FIG. 6. In FIG. 7, a treatment protocol 120 begins with the occurrence of a new event, as indicated by a beginning locus 122.

Treatment protocol 120 continues by posing a query whether the new event being treated is substantially identical to the last reported event, as indicated by a query block 124. If the new event is substantially identical to the last reported event, treatment protocol 120 continues from query block 124 via a YES response line 126 and an occurrence count for the last event reported is incremented in first memory unit 116 (FIG. 6), as indicated by a block 128. Maintaining an incremented count for tracking substantially identical occurrences is a treatment step that permits counting occurrences while conserving memory. Alternatively, each separate occurrence may be accounted for using a separate memory entry and no occurrence count may be required.

Treatment protocol 120 continues by updating the recorded day and time of occurrence of the latest-to-occur similar event, as indicated by a block 130. Updating the recorded day and time of occurrence of the latest-to-occur similar event may be an optional treatment step, as indicated by the broken line format of block 130. If an alternate design is employed in which a separate occurrence is accounted for using a separate memory entry, a date and time entry may accompany the event notation in storage and no updating of the day and time of occurrence of the latest-to-occur similar event may be required.

If the new event is not substantially identical to the last reported event, treatment protocol 120 continues from query block 124 via a NO response line 132 and a record of the occurrence of the new event is pushed to the top of first memory units 116, as indicated by a block 134. When the record of the occurrence of the new event is pushed to the top of first memory unit 116, a count indicating occurrence of the new event may be set to 1, as also indicated by block 134. Treatment protocol 120 may continue by setting the first and last occurrence day and time entries for the new event, as indicated by a block 136. Setting the first and last occurrence day and time entries for the new event may be an optional treatment step, as indicated by the broken line format of block 136.

Treatment protocol 120 may continue from block 130 or from block 136 to an exit locus 138.

Figure 8:
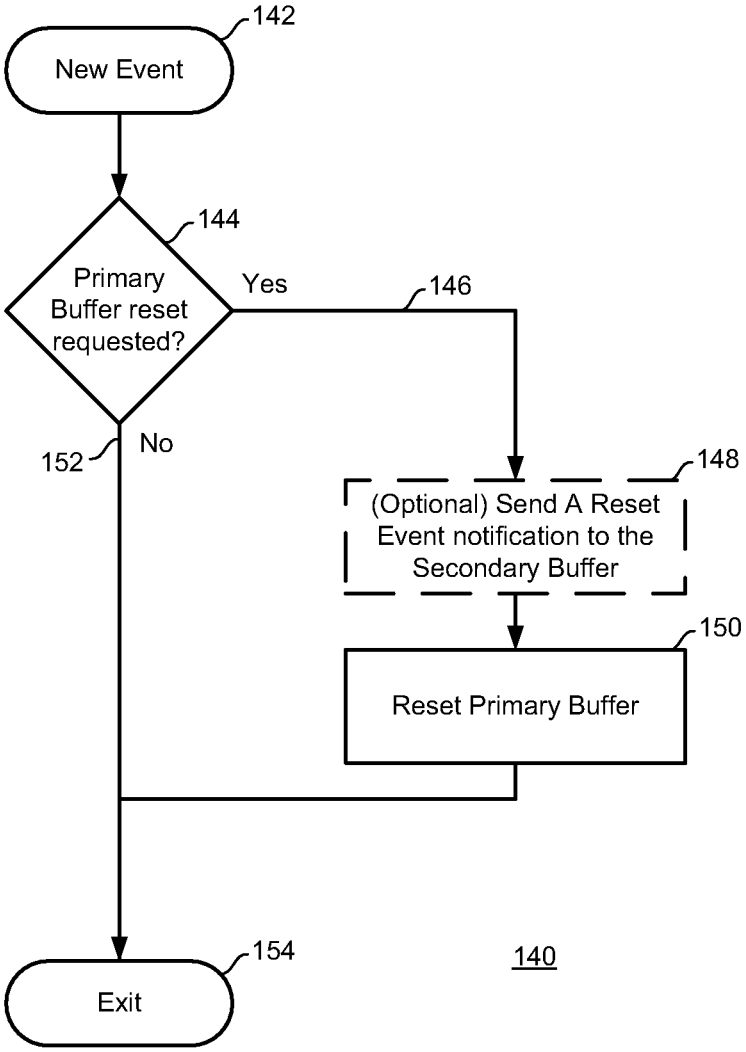
FIG. 8 is a flow diagram illustrating treatment of a reset event in a first buffer unit of the embodiment of the apparatus illustrated in FIG. 6.

FIG. 8 is a flow diagram illustrating treatment of a reset event in a first buffer unit of the embodiment of the apparatus illustrated in FIG. 6. In FIG. 8, a treatment protocol 140 begins with the occurrence of a reset event, as indicated by a beginning locus 142. A reset event may occur, by way of example and not by way of limitation, when a RESET signal or other RESET indication is received at a RESET locus (e.g., RESET locus 115; FIG. 6). A reset event may cause a resetting or erasing of entries in a memory unit or may otherwise empty a memory unit.

Treatment protocol 140 continues by posing a query whether a resetting of a primary buffer (e.g., first memory unit 116; FIG. 6) is being requested, as indicated by a query block 144. If a resetting of a primary buffer is being requested, treatment protocol 140 continues from query block 144 via a YES response line 146 information relating to the reset event is stored in the secondary buffer (e.g., second memory unit 118; FIG. 3), as indicated by a block 148. Such related information to be stored may include, by way of example and not by way of limitation, the occurrence of a reset event, and the date and time of the occurrence. Storing information relating to the reset event may be an optional treatment step, as indicated by the broken line format of block 148.

Treatment protocol 140 may continue by resetting the primary buffer (e.g., first memory unit 116; FIG. 6), as indicated by a block 150. Treatment protocol 140 may continue from block 150 to an exit locus 154.

If a resetting of a primary buffer is not being requested, treatment protocol 140 continues from query block 144 via a NO response line 152 to exit locus 154.

Figure 9:
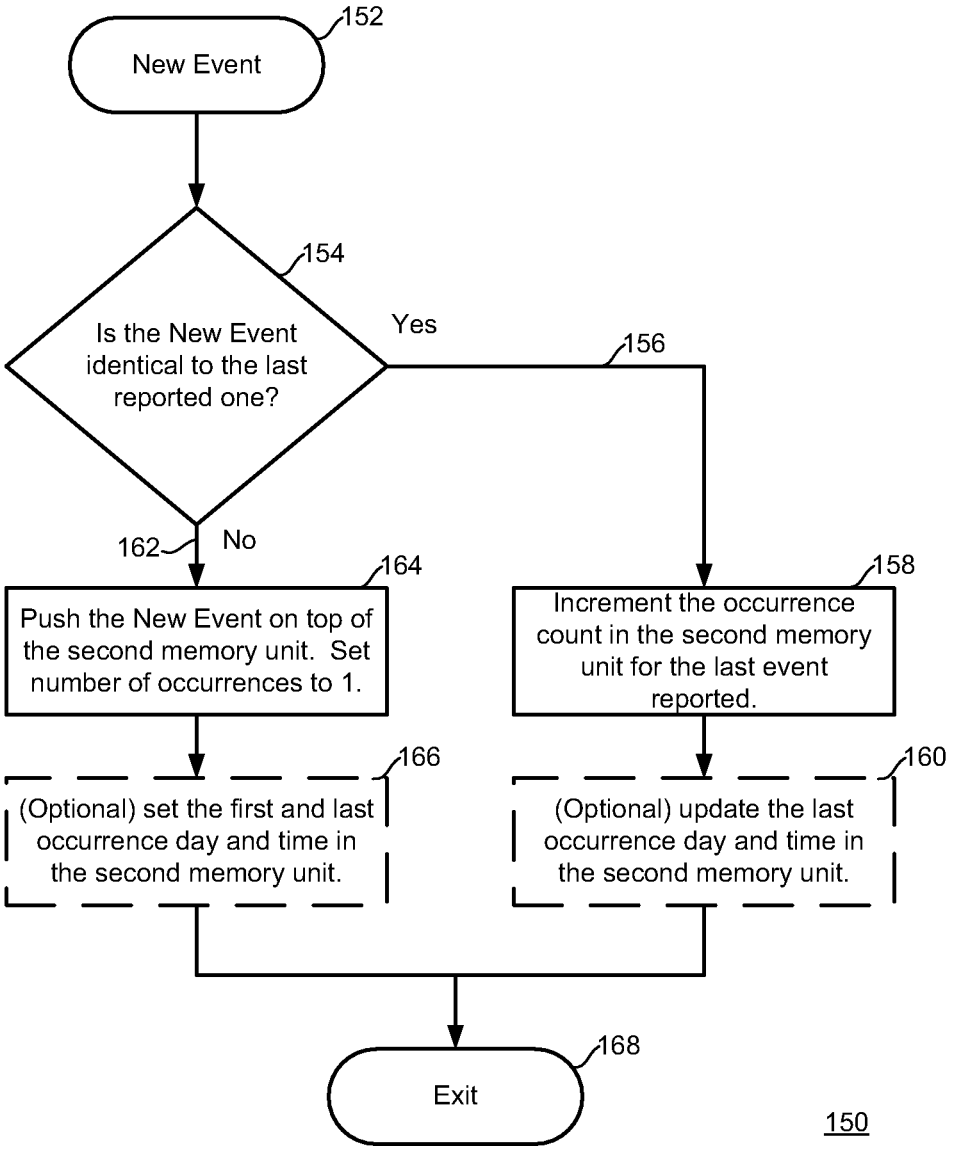
FIG. 9 is a flow chart illustrating treatment of event information in a second buffer unit of the embodiment of the apparatus illustrated in FIG. 6.

FIG. 9 is a flow chart illustrating treatment of event information in a second buffer unit of the embodiment of the apparatus illustrated in FIG. 6. In FIG. 9, a treatment protocol 150 begins with the occurrence of a new event, as indicated by a beginning locus 152.

Treatment protocol 150 continues by posing a query whether the new event being treated is substantially identical to the last reported event, as indicated by a query block 154. If the new event is substantially identical to the last reported event, treatment protocol 150 continues from query block 154 via a YES response line 156 and an occurrence count for the last event reported is incremented in second memory unit 118 (FIG. 6), as indicated by a block 158. Maintaining an incremented count for tracking substantially identical occurrences is a treatment step that permits counting occurrences while conserving memory. Alternatively, each separate occurrence may be accounted for using a separate memory entry and no occurrence count may be required.

Treatment protocol 150 continues by updating the recorded day and time of occurrence of the latest-to-occur similar event, as indicated by a block 160. Updating the recorded day and time of occurrence of the latest-to-occur similar event may be an optional treatment step, as indicated by the broken line format of block 160. If an alternate design is employed in which a separate occurrence is accounted for using a separate memory entry, a date and time entry may accompany the event notation in storage and no updating of the day and time of occurrence of the latest-to-occur similar event may be required.

If the new event is not substantially identical to the last reported event, treatment protocol 150 continues from query block 154 via a NO response line 162 and a record of the occurrence of the new event is pushed to the top of second memory unit 118, as indicated by a block 164. When the record of the occurrence of the new event is pushed to the top of second memory unit 118, a count indicating occurrence of the new event may be set to 1, as also indicated by block 164. Treatment protocol 150 may continue by setting the first and last occurrence day and time entries for the new event, as indicated by a block 166. Setting the first and last occurrence day and time entries for the new event may be an optional treatment step, as indicated by the broken line format of block 166.

Treatment protocol 150 may continue from block 160 or from block 166 to an exit locus 168.

Figure 10:
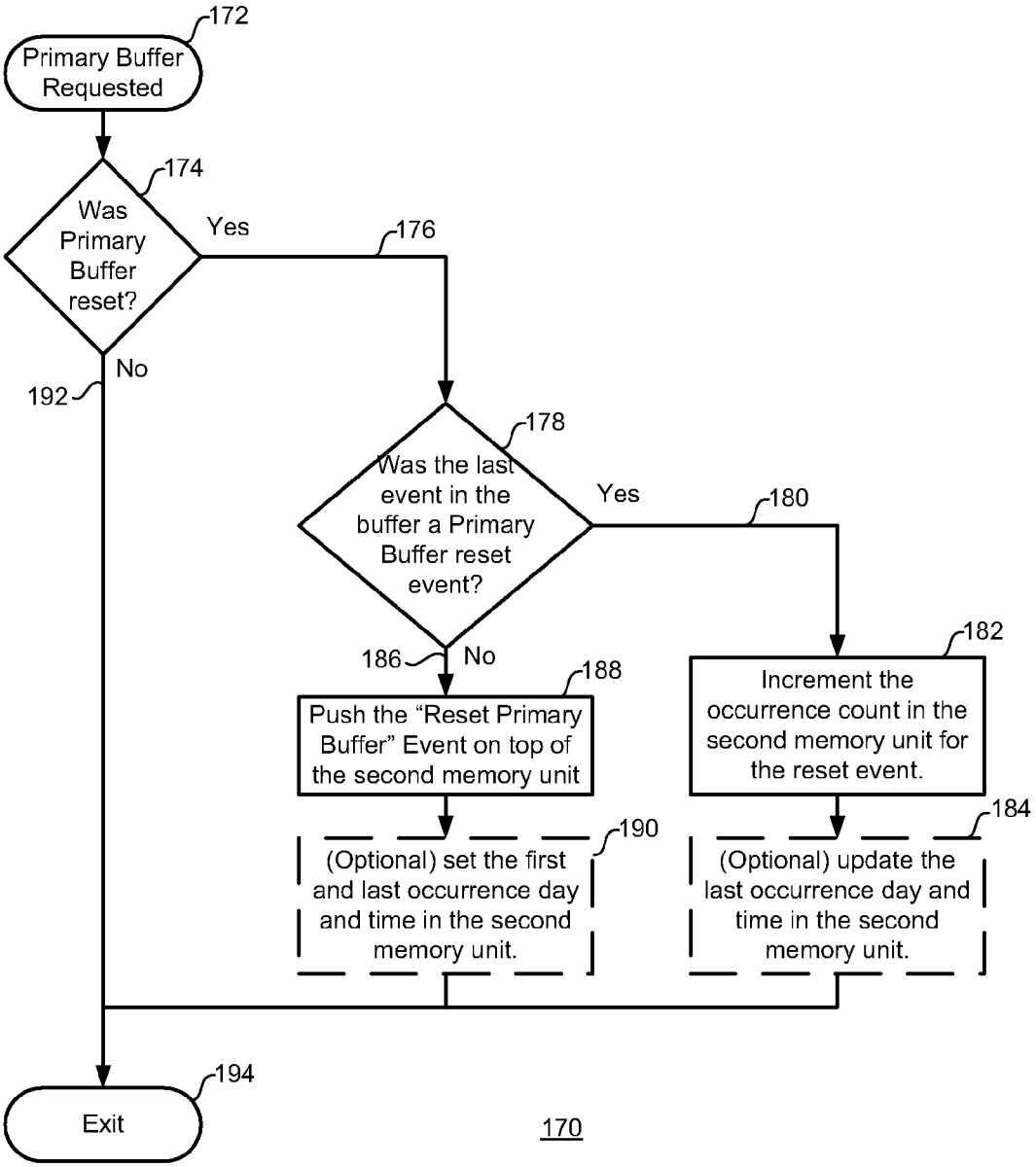
FIG. 10 is a flow diagram illustrating treatment of a reset event in a second buffer unit of the embodiment of the apparatus illustrated in FIG. 6.

FIG. 10 is a flow diagram illustrating treatment of a reset event in a second buffer unit of the embodiment of the apparatus illustrated in FIG. 6. In FIG. 10, a treatment protocol 170 begins with the occurrence of a reset event requesting reset of a primary buffer (e.g., first memory unit 116; FIG. 6), as indicated by a beginning locus 172.

Treatment protocol 170 continues by posing a query whether the primary buffer was reset, as indicated by a query block 174. If the primary buffer was reset, treatment protocol 170 continues from query block 174 via a YES response line 176 and poses a query whether the last event was a primary buffer reset event, as indicated by a query block 178.

If the last event was a primary buffer reset event, treatment protocol 170 continues from query block 178 via a YES response line 180 and an occurrence count for the last reset event reported is incremented in second memory unit 118 (FIG. 6), as indicated by a block 182. Maintaining an incremented count for tracking substantially identical occurrences, such as reset events, is a treatment step that permits counting occurrences while conserving memory. Alternatively, each separate reset event occurrence may be accounted for using a separate memory entry and no reset event occurrence count may be required.

Treatment protocol 170 continues by updating the recorded day and time of the latest-to-occur reset event, as indicated by a block 184. Updating the recorded day and time of occurrence of the latest-to-occur reset event may be an optional treatment step, as indicated by the broken line format of block 184. If an alternate design is employed in which a separate reset event occurrence is accounted for using a separate memory entry, a date and time entry may accompany the reset event notation in storage and no updating of the day and time of the latest-to-occur reset event may be required.

If the last event was not a primary buffer reset event, treatment protocol 170 continues from query block 178 via a NO response line 186 a record of the "Reset Primary Buffer" event is pushed to the top of second memory unit 118 (FIG. 6), as indicated by a block 188. When the record of the occurrence of the "Reset Primary Buffer" event is pushed to the top of second memory unit 118, a count indicating occurrence of the "Reset Primary Buffer" event may be set to 1. Treatment protocol 170 may continue by setting the first and last occurrence day and time entries for the "Reset Primary Buffer" event, as indicated by a block 190. Setting the first and last occurrence day and time entries for the "Reset Primary Buffer" event may be an optional treatment step, as indicated by the broken line format of block 190.

If the primary buffer was not reset, treatment protocol 170 continues from query block 174 via a NO response line 192. Treatment protocol 170 may continue from query block 174 via a NO response line 192 or from block 184 to an exit locus 194.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims:

We claim:

1. An apparatus for storing event information relating to operation of an HVAC system; the apparatus comprising:

(a) at least one memory controller coupled with said HVAC system for receiving said event information; and (b) at least one memory unit coupled with said at least one memory controller; a first memory unit of said at least one memory unit being configured for receiving first selected information of said event information for accessing by at least one of a first party and a second party; a second memory unit of said at least one memory unit being configured for receiving second selected information of said event information for accessing by said second party, said second selected information including reset event information of said first memory unit;

wherein said event information includes alarm event information that indicates types of alarms associated with operating said HVAC system, operating parameters of said HVAC system associated with an occurrence of an alarm thereof, or alarm clears of said HVAC system.

2. An apparatus for storing event information relating to operation of an HVAC system as recited in claim 1 wherein said second party is a servicing party, and wherein said accessing said second selected information is a controlled accessing.

3. An apparatus for storing event information relating to operation of an HVAC system as recited in claim 1 wherein said second selected information is more detailed than said first selected information.

4. An apparatus for storing event information relating to operation of an HVAC system as recited in claim 1 wherein said second memory unit is a rolling buffer unit storing a limited number of most-recently received entries of said event information.

5. An apparatus for storing event information relating to operation of an HVAC system as recited in claim 4 wherein said first memory unit is a virtual rolling buffer unit including pointers; said pointers pointing to a subset of information contained in said limited number of most-recently received entries.

6. An apparatus for storing event information relating to operation of an HVAC system as recited in claim 5 wherein said subset of information is contained in a smaller number of said most-recently received entries than said limited number.

7. An apparatus for storing event information relating to operation of an HVAC system as recited in claim 1 wherein said at least one memory controller is a common memory controller coupled with said first memory unit and said second memory unit, wherein said first memory unit is a first rolling buffer unit storing a first limited number of most-recently received entries of selected information items of said event information, and wherein said second memory unit is a second rolling buffer unit storing a second limited number of most-recently received entries of said event information.

8. An apparatus for storing event information relating to operation of an HVAC system as recited in claim 1 wherein said at least one memory controller is a first memory controller coupled with said first memory unit and a second memory controller coupled with said second memory unit, wherein said first memory unit is a first rolling buffer unit storing a first limited number of most-recently received entries of selected information items of said event information, and wherein said second memory unit is a second rolling buffer unit storing a second limited number of most-recently received entries of said event information.

9. An apparatus for storing event information relating to operation of an HVAC system as recited in claim 5 wherein said types of alarms associated with operating said HVAC system includes a continuous alarm related to a continuously monitored event associated with operating said HVAC system and an occasion-based alarm related to an occurrence of a particular event associated with operating said HVAC system.

10. An apparatus for storing event information relating to operation of an HVAC system as recited in claim 1 wherein said operating parameters of said HVAC system associated with an occurrence of an alarm thereof including at least one of specified parameters extant when an alarm occurs, before an alarm occurs, after an alarm occurs, and during a time interval spanning a time at which an alarm occurs.

11. An apparatus for storing event information relating to operation of an HVAC system as recited in claim 1 wherein said alarm clears of said HVAC system identifying at least one earlier occurring alarm to which said alarm clears pertain.

12. An apparatus storing operating information relating to a communicating control system; the apparatus comprising:

(a) at least one controller unit coupled with said communicating control system; and (b) a memory unit coupled with said at least one controller unit; said memory unit including a first memory device and a second memory device; said first memory device being configured for storing first selected information of said operational information; said second memory device being configured for storing second selected information of said operational information; said first memory device being configured for permitting access to said first selected information without restriction; said second memory device permitting only authorized access to said second selected information, said second selected information including reset event information of said first memory unit;

wherein said operating information includes alarm event information that indicates types of alarms associated with operating said communicating control system, operating parameters of said communicating control system associated with an occurrence of an alarm thereof, or alarm clears of said communicating control system.

13. An apparatus storing operational information relating to a communicating control system as recited in claim 12 wherein said first memory device is a virtual rolling buffer unit including pointers; said pointers pointing to a subset of information contained in said second selected information; said second memory device being a rolling buffer unit; said second selected information being a limited number of most-recently received entries of said operational information.

14. An apparatus storing operational information relating to a communicating control system as recited in claim 12 wherein said at least one controller unit is a common memory controller coupled with said first memory device and said second memory device, wherein said first memory device is a first rolling buffer unit, and wherein said second memory device is a second rolling buffer unit; said first selected information being a first limited number of a portion of most-recently received entries of said operational information; said second selected information being a second limited number of most-recently received entries of said operational information.

15. An apparatus storing operational information relating to a communicating control system as recited in claim 12 wherein said at least one controller unit is a first memory controller coupled with said first memory device and a second memory controller coupled with said second memory device, wherein said first memory device is a first rolling buffer unit and said second memory device is a second rolling buffer unit; said first selected information being a first limited number of a portion of most-recently received entries of said operational information; said second selected information being a second limited number of most-recently received entries of said operational information.

16. A method for storing event information relating to operation of an HVAC system; the method comprising:

(a) providing at least one memory controller coupled with said HVAC system for receiving said event information;

(b) providing at least one memory unit coupled with said at least one memory controller;

(c) in no particular order:

(1) configuring a first memory unit of said at least one memory unit for storing first selected information of said event; and (2) configuring a second memory unit of said at least one memory unit for storing second selected information of said event information; and (d) in no particular order:

(1) operating said first memory unit for permitting access to said first selected information by at least one of a first party and a second party; and (2) operating said second memory unit for permitting access to said second selected information by said second party, said second selected information including reset event information of said first memory unit;

wherein said event information includes alarm event information that indicates types of alarms associated with operating said HVAC system, operating parameters of said HVAC system associated with an occurrence of an alarm thereof, or alarm clears of said HVAC system.

17. A method for storing event information relating to operation of an HVAC system as recited in claim 16 wherein said first memory unit is a virtual rolling buffer unit including pointers; said pointers pointing to a subset of information contained in said second selected information; said second memory unit being a rolling buffer unit; said second selected information being a limited number of most-recently received entries of said event information.

18. A method for storing event information relating to operation of an HVAC system as recited in claim 16 wherein said at least one memory controller is a common memory controller coupled with said first memory unit and said second memory unit, wherein said first memory unit is a first rolling buffer unit, and wherein said second memory unit is a second rolling buffer unit; said first selected information being a first limited number of a portion of most-recently received entries of said event information; said second selected information being a second limited number of most-recently received entries of said event information.

19. A method for storing event information relating to operation of an HVAC system as recited in claim 16 wherein said at least one memory controller is a first memory controller coupled with said first memory unit and a second memory controller coupled with said second memory unit, wherein said first memory unit is a first rolling buffer unit and said second memory unit is a second rolling buffer unit; said first selected information being a first limited number of a portion of most-recently received entries of said event information; said second selected information being a second limited number of most-recently received entries of said event information.

20. A method for storing event information relating to operation of an HVAC system as recited in claim 16 wherein said second party is a servicing party, and wherein said accessing said second selected information is a controlled accessing.

* * * * *